US009844709B2

(12) United States Patent
Tassistro

(10) Patent No.: US 9,844,709 B2
(45) Date of Patent: Dec. 19, 2017

(54) GOLF CLUB STRIKING SURFACE

(71) Applicant: Acushnet Company, Fairhaven, MA (US)

(72) Inventor: Kevin Tassistro, San Marcos, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 14/863,724

(22) Filed: Sep. 24, 2015

(65) Prior Publication Data

US 2017/0087423 A1 Mar. 30, 2017

(51) Int. Cl.
*A63B 53/04* (2015.01)

(52) U.S. Cl.
CPC .... *A63B 53/047* (2013.01); *A63B 2053/0445* (2013.01)

(58) Field of Classification Search
CPC .... A63B 2053/0445; A63B 2053/0416; A63B 53/04; A63B 53/047
See application file for complete search history.

(56) References Cited

U.S. PATENT DOCUMENTS

| | | | |
|---|---|---|---|
| 732,136 | A | 6/1903 | Taylor |
| 732,137 | A | 6/1903 | Taylor |
| 1,188,479 | A | 6/1916 | Park |
| 1,289,553 | A | 12/1918 | Sanders |
| 1,337,958 | A | 4/1920 | Reach |
| 1,526,951 | A | 2/1925 | Beaumont |
| 3,869,126 | A | 3/1975 | Thompson |
| 3,989,861 | A | 11/1976 | Rasmussen |
| 4,413,825 | A | 11/1983 | Sasse |
| 4,529,203 | A | 7/1985 | Ribaudo |
| 4,754,970 | A | 7/1988 | Kobayashi |
| 4,768,787 | A | 9/1988 | Shira |
| 4,869,508 | A | 9/1989 | Miller |
| 4,902,016 | A | 2/1990 | Boone |
| 4,964,641 | A | 10/1990 | Miesch et al. |
| 5,029,864 | A | 7/1991 | Keener |
| 5,354,059 | A | 10/1994 | Stuff |
| 5,437,088 | A | 8/1995 | Igarashi |

(Continued)

FOREIGN PATENT DOCUMENTS

| | | |
|---|---|---|
| JP | H 04336083 | 11/1992 |
| JP | H 0956855 | 3/1997 |

(Continued)

*Primary Examiner* — John E Simms, Jr.
(74) *Attorney, Agent, or Firm* — Kevin N. McCoy

(57) ABSTRACT

A golf club head, including a striking face having a plurality of grooves formed therein, a center region, a toe region, and a heel region, a plurality of miniature grooves formed therein, the plurality of miniature grooves limited to the central region of the striking face, each of the plurality of miniature grooves extending across the striking face parallel to the grooves, each of the plurality of miniature grooves having a miniature groove width of less than 0.500 mm, wherein the miniature groove width is the distance between an uppermost intersection of each miniature groove and the front surface and a lowermost intersection of each miniature groove and the front surface; a plurality of arcuate grooves limited to the toe region; wherein the grooves, the miniature grooves, and the arcuate grooves do not intersect one another.

12 Claims, 6 Drawing Sheets

(56) References Cited

U.S. PATENT DOCUMENTS 5,505,450 A 4/1996 Stuff
5,591,092 A 1/1997 Gilbert et al.
5,595,547 A 1/1997 Lekavich
5,618,239 A 4/1997 Rife
5,637,044 A 6/1997 Swash
5,688,186 A 11/1997 Michaels et al.
5,688,190 A 11/1997 Rowland et al.
5,690,561 A 11/1997 Rowland et al.
5,709,616 A 1/1998 Rife
5,785,610 A 7/1998 Birmingham
6,089,993 A 7/2000 Woodward et al.
6,099,414 A 8/2000 Kusano et al.
6,183,379 B1 2/2001 Kim et al.
6,196,936 B1 3/2001 Meckel
6,224,497 B1 5/2001 Antonious
6,257,994 B1 7/2001 Antonious
6,348,010 B1 2/2002 Doolen
6,348,011 B1 2/2002 Reyes et al.
6,398,655 B1 6/2002 Antonious
6,554,721 B1 4/2003 Woodward et al.
6,605,006 B2 8/2003 Mason
6,739,984 B1 5/2004 Ciasullo
6,814,673 B2 11/2004 Wahl et al.
6,890,270 B2 5/2005 Ciasullo
6,981,923 B2 1/2006 Chappell
7,014,568 B2 3/2006 Pelz
7,056,226 B2 6/2006 Kennedy
7,166,039 B2 1/2007 Hettinger et al.
7,192,361 B2 3/2007 Gilbert et al.
7,273,418 B2 9/2007 Gilbert et al.
7,273,422 B2 9/2007 Vokey et al.
7,278,926 B2 10/2007 Frame
7,278,928 B2 10/2007 Newman et al.
7,285,057 B2 10/2007 Mann, Jr. et al.
7,445,561 B2 11/2008 Newman et al.
7,452,283 B2 11/2008 Hettinger et al.
7,465,240 B2 12/2008 Frame
7,540,810 B2 6/2009 Hettinger et al.
7,568,983 B2 8/2009 Gilbert et al.
7,594,862 B2 9/2009 Gilbert et al.
7,594,863 B2 9/2009 Ban
7,662,049 B2 2/2010 Park et al.
7,674,188 B2 3/2010 Ban et al.
7,677,990 B2 3/2010 Ban et al.
7,695,377 B2 4/2010 Yamagishi et al.
7,758,449 B2 7/2010 Gilbert et al.
7,780,548 B2 8/2010 Solheim
7,780,549 B2 8/2010 Park et al.
7,815,521 B2 10/2010 Ban et al.
7,819,756 B2 10/2010 Ban et al.
7,828,671 B2 11/2010 Ban et al.
7,846,039 B2 12/2010 Gilbert et al.
7,846,040 B2 12/2010 Ban et al.
7,862,450 B2 1/2011 Gilbert et al.
7,878,923 B2 2/2011 Yamagishi et al.
7,901,297 B2 3/2011 Ban et al.
7,905,797 B2 3/2011 Gilbert et al.
7,909,708 B2 3/2011 Gilbert et al.
7,918,747 B2 4/2011 Johnson et al.
7,922,601 B2 4/2011 Ban et al.
7,955,189 B2 6/2011 Vokey et al.
7,976,404 B2 7/2011 Golden et al.
7,976,405 B2 7/2011 Gilbert et al.
7,976,406 B2 7/2011 Gilbert et al.
8,012,036 B2 * 9/2011 Nakamura ..... A63B 53/00 473/290
8,033,929 B2 10/2011 Yamagishi et al.
8,092,320 B2 1/2012 Yamagishi et al.
8,109,840 B2 2/2012 Gilbert et al.
8,113,965 B2 2/2012 Ban et al.
8,128,510 B2 3/2012 Gilbert et al.
8,128,511 B2 3/2012 Golden et al.
8,128,512 B2 3/2012 Gilbert et al.
8,128,513 B2 3/2012 Gilbert et al.
8,142,309 B2 3/2012 Johnson et al.
8,157,673 B2 4/2012 Gilbert et al.
8,172,699 B2 5/2012 Nakamura
8,206,240 B2 6/2012 Park et al.
8,287,401 B2 10/2012 Tateno et al.
8,337,324 B2 12/2012 Sander et al.
8,342,981 B2 1/2013 Johnson et al.
8,348,784 B2 1/2013 Gilbert et al.
8,376,877 B1 2/2013 Galloway
8,506,420 B2 8/2013 Hocknell et al.
2004/0038745 A1 2/2004 Ahlqvist
2004/0127300 A1 7/2004 Roesgen et al.
2004/0192465 A1 9/2004 Erb et al.
2005/0009623 A1 1/2005 Dickinson
2005/0130761 A1 7/2005 Vokey et al.
2006/0025233 A1 2/2006 Lin
2007/0082752 A1 4/2007 Boyd
2008/0051212 A1 2/2008 Voges
2008/0125243 A1 5/2008 Ban
2008/0132351 A1 6/2008 Ban et al.
2008/0132352 A1 6/2008 Ban
2008/0242443 A1 10/2008 Gilbert et al.
2009/0163291 A1 6/2009 Chao
2009/0176597 A1 * 7/2009 Yamagishi ..... A63B 53/047 473/331
2009/0209362 A1 8/2009 Petersen et al.
2009/0247318 A1 10/2009 Ban et al.
2009/0264217 A1 10/2009 Johnson et al.
2009/0313806 A1 12/2009 Gilbert
2009/0325728 A1 12/2009 Solheim
2010/0029401 A1 * 2/2010 Nakamura ..... A63B 53/00 473/290
2010/0035703 A1 * 2/2010 Ishikawa ..... A63B 53/0487 473/340
2011/0111883 A1 5/2011 Cackett
2011/0172026 A1 * 7/2011 Cackett ..... A63B 53/047 473/331
2011/0269567 A1 11/2011 Ban
2011/0269568 A1 * 11/2011 Ban ..... A63B 53/047 473/331
2011/0269569 A1 11/2011 Golden et al.
2011/0275451 A1 11/2011 Chao
2011/0294596 A1 12/2011 Ban
2011/0300967 A1 12/2011 Ban
2012/0071269 A1 3/2012 Rahrig et al.
2012/0165114 A1 6/2012 Golden et al.
2012/0184391 A1 7/2012 Johnson et al.
2012/0190477 A1 7/2012 Nakamura
2012/0264537 A1 10/2012 Breier
2013/0053171 A1 * 2/2013 Carlyle ..... A63B 53/047 473/331
2013/0217513 A1 * 8/2013 Amano ..... A63B 53/047 473/331
2013/0225319 A1 * 8/2013 Kato ..... A63B 53/047 473/331
2013/0281226 A1 * 10/2013 Ban ..... B23K 26/367 473/331
2013/0288820 A1 * 10/2013 Shimahara ..... A63B 53/04 473/331
2014/0206472 A1 * 7/2014 Aguayo ..... B23K 26/0084 473/331
2014/0206473 A1 * 7/2014 Ripp ..... B21D 22/00 473/331

FOREIGN PATENT DOCUMENTS

JP H 0999120 4/1997
JP H 09253250 9/1997
JP H 08229169 5/1999
JP H 11137746 5/1999
JP 2004321530 11/2004
WO WO 00/47794 8/2000

* cited by examiner

GOLF CLUB STRIKING SURFACE

TECHNICAL FIELD

The present technology generally relates to systems, devices, and methods related to golf clubs, and more specifically to golf clubs having an improved striking surface.

DESCRIPTION OF THE RELATED TECHNOLOGY

Golf clubs, combined with golf balls, have generally been considered to be the most essential equipment in the game of golf. Progressing in parallel with the development of the game of golf, significant developments have occurred within the golf equipment industry. Golf clubs have also developed simultaneously with all other types of golf equipment to accommodate for the needs of the golfer to hit their shots more accurately and with more control.

Iron type golf clubs include both conventional iron clubs as well as wedges. Each golf club includes a shaft with a club head attached to the distal end of the shaft and a grip attached to the proximal end of the shaft. The club head includes a face for striking a golf ball. In general, the greater the loft of the golf club in a set, the greater the launch angle and the less distance the golf ball is hit. A set of conventional irons generally includes individual irons that are designated as number 3 through number 9, and a pitching wedge. The conventional iron set is generally complimented by a series of wedges, such as a lob wedge, a gap wedge, and/or a sand wedge. Sets can also include a 1 and 2 iron, but these golf clubs are generally sold separately from the set. Each iron type golf club has a shaft length that usually decreases through the set as the set as the loft for each golf club head increases, from the long irons to the short irons. Additionally, iron type golf clubs generally include grooves running across the striking face from the heel towards the toe to increase the friction between the striking face and golf ball, inducing spin on the golf ball as the striking face impacts the golf ball. Wedges, are a particular type of iron type golf club that generally has a higher loft angle. These higher lofted wedges tend to be precision instruments that allow a golfer to dial in short range golf shots with improved trajectory, improved accuracy, and improved control.

Conventional iron type golf club heads are created in a variety of ways, some of which include castings, forgings, as well as combinations of the two. Generally, conventional production iron type golf club heads are cast or forged to a near net final shape, such that only minor machining and/or grinding operations are necessary to achieve the finished product.

SUMMARY

The systems, methods, and devices described herein have innovative aspects, no single one of which is indispensable or solely responsible for their desirable attributes. Without limiting the scope of the claims, some of the advantageous features will now be summarized.

The present technology generally relates to systems, devices, and methods related to golf clubs, and more specifically to golf clubs having an improved striking surface.

The present technology is directed to an improved striking surface for golf clubs, and more specifically iron type golf clubs. The improved striking surface improves the performance of the golf club by increasing the amount of backspin created by the golf club when striking the golf ball, improving ball flight as well as stopping power on the green.

One non-limiting embodiment of the present technology includes a golf club head, comprising: a body, said body comprising: a striking face on a forward portion of said body, said striking face configured to strike a golf ball; a sole on a bottom portion of said body; a top line on a top portion of said body; a hosel configured to receive a shaft, said hosel located on a heel side of said body, said heel side opposite a toe side of said body; wherein said striking face comprises a plurality of grooves formed therein, each of said plurality of grooves extending horizontally across said striking face; each of said plurality of grooves having a groove width greater than or equal to 0.500 mm; wherein said striking face comprises a front surface, and wherein said groove width of each groove is the distance between an uppermost intersection of each groove and said front surface and a lowermost intersection of each groove and said front surface; wherein said striking face comprises a center region, a toe region, and a heel region, said center region extending from a toe most portion of said grooves to a heel most portion of said grooves, said heel region located on a heel side of said center region and said toe region located on a toe side of said center region; a plurality of miniature grooves formed in said striking face, said plurality of miniature grooves limited to said central region of said striking face, each of said plurality of miniature grooves extending across said striking face parallel to said grooves, each of said plurality of miniature grooves having a miniature groove width of less than 0.500 mm, wherein said miniature groove width is the distance between an uppermost intersection of each miniature groove and said front surface and a lowermost intersection of each miniature groove and said front surface; and a plurality of arcuate grooves limited to said toe region; wherein said grooves, said miniature grooves, and said arcuate grooves do not intersect one another.

In an additional non-limiting embodiment of the present technology said striking face comprises a plurality of groove absent regions, said groove absent regions located between each pair of said plurality of grooves, wherein each groove absent region comprises at least three miniature grooves.

In an additional non-limiting embodiment of the present technology each groove absent region comprises at least four miniature grooves and less than eight miniature grooves.

In an additional non-limiting embodiment of the present technology each groove absent region comprises five miniature grooves.

In an additional non-limiting embodiment of the present technology offset width below is the distance between said lowermost intersection of each of said plurality of grooves and said front surface and the closest intersection of said plurality of miniature grooves and said front surface, wherein offset width above is the distance between said uppermost intersection of each of said grooves and said front surface and the closest intersection of said plurality of miniature grooves and said front surface, wherein said offset width below and said offset width above of each of said plurality of grooves are each greater than or equal to 0.352 mm.

In an additional non-limiting embodiment of the present technology offset width below is the distance between said lowermost intersection of each of said plurality of grooves and said front surface and the closest intersection of said plurality of miniature grooves and said front surface, wherein offset width above is the distance between said uppermost intersection of each of said grooves and said front surface and the closest intersection of said plurality of miniature grooves and said front surface, wherein miniature groove pitch is the distance between corresponding points on each of said plurality of miniature grooves within each of said groove absent regions, and wherein said offset width above, said offset width below, said miniature groove pitch, said groove width, and said miniature groove width, each measured in millimeters, satisfy the following relationship:

$$\frac{(OWA + OWB)}{2} > \left(\sqrt{MGP + GW} - \sqrt{MGP + GW - MGW}\right)^3$$

An additional non-limiting embodiment of the present technology includes a golf club head, comprising: a body, said body comprising: a striking face on a forward portion of said body, said striking face configured to strike a golf ball; a sole on a bottom portion of said body; a top line on a top portion of said body; a hosel configured to receive a shaft, said hosel located on a heel side of said body, said heel side opposite a toe side of said body; wherein said striking face comprises a plurality of grooves formed therein, each of said plurality of grooves extending horizontally across said striking face; each of said plurality of grooves having a groove width greater than or equal to 0.500 mm; wherein said striking face comprises a front surface, and wherein said groove width of each groove is the distance between an uppermost intersection of each groove and said front surface and a lowermost intersection of each groove and said front surface; wherein said striking face comprises a center region, a toe region, and a heel region, said center region extending from a toe most portion of said grooves to a heel most portion of said grooves, said heel region located on a heel side of said center region and said toe region located on a toe side of said center region; and a plurality of miniature grooves formed in said striking face, each of said plurality of miniature grooves extending across said striking face parallel to said grooves, each of said plurality of miniature grooves having a miniature groove width of less than 0.500 mm, wherein said miniature groove width is the distance between an uppermost intersection of each miniature groove and said front surface and a lowermost intersection of each miniature groove and said front surface; wherein said striking face comprises a plurality of groove absent regions, said groove absent regions located between each pair of said plurality of grooves, wherein each groove absent region comprises at least three miniature grooves; wherein offset width below is the distance between said lowermost intersection of each of said plurality of grooves and said front surface and the closest intersection of said plurality of miniature grooves and said front surface, wherein offset width above is the distance between said uppermost intersection of each of said grooves and said front surface and the closest intersection of said plurality of miniature grooves and said front surface, wherein miniature groove pitch is the distance between corresponding points on each of said plurality of miniature grooves within each of said groove absent regions, and wherein said offset width above, said offset width below, said miniature groove pitch, said groove width, and said miniature groove width, each measured in millimeters, satisfy the following relationship:

$$\frac{(OWA + OWB)}{2} > \left(\sqrt{MGP + GW} - \sqrt{MGP + GW - MGW}\right)^3$$

In an additional non-limiting embodiment of the present technology each groove absent region comprises at least four miniature grooves and less than eight miniature grooves.

In an additional non-limiting embodiment of the present technology said offset width below and said offset width above of each of said plurality of grooves are each greater than or equal to 0.352 mm.

In an additional non-limiting embodiment of the present technology said offset width below and said offset width above of each of said plurality of grooves are each greater than or equal to 0.402 mm.

In an additional non-limiting embodiment of the present technology said grooves and said miniature grooves do not intersect one another.

In an additional non-limiting embodiment of the present technology said plurality of miniature grooves are limited to said central region of said striking face.

An additional non-limiting embodiment of the present technology includes a plurality of arcuate grooves limited to said toe region; wherein said grooves, said miniature grooves, and said arcuate grooves do not intersect one another An additional non-limiting embodiment of the present technology includes a golf club head, comprising: a body, said body comprising: a striking face on a forward portion of said body, said striking face configured to strike a golf ball; a sole on a bottom portion of said body; a top line on a top portion of said body; a hosel configured to receive a shaft, said hosel located on a heel side of said body, said heel side opposite a toe side of said body; wherein said striking face comprises a plurality of grooves formed therein, each of said plurality of grooves extending horizontally across said striking face; each of said plurality of grooves having a groove width greater than or equal to 0.500 mm; wherein said striking face comprises a front surface, and wherein said groove width of each groove is the distance between an uppermost intersection of each groove and said front surface and a lowermost intersection of each groove and said front surface; wherein said striking face comprises a center region, a toe region, and a heel region, said center region extending from a toe most portion of said grooves to a heel most portion of said grooves, said heel region located on a heel side of said center region and said toe region located on a toe side of said center region; and a plurality of miniature grooves formed in said striking face, each of said plurality of miniature grooves extending across said striking face parallel to said grooves, each of said plurality of miniature grooves having a miniature groove width of less than 0.500 mm, wherein said miniature groove width is the distance between an uppermost intersection of each miniature groove and said front surface and a lowermost intersection of each miniature groove and said front surface; wherein offset width below is the distance between said lowermost intersection of each of said plurality of grooves and said front surface and the closest intersection of said plurality of miniature grooves and said front surface, wherein offset width above is the distance between said uppermost intersection of each of said grooves and said front surface and the closest intersection of said plurality of miniature grooves and said front surface, wherein said offset width below and said offset width above of each of said plurality of grooves are each greater than or equal to 0.352 mm; wherein said striking face comprises a plurality of groove absent regions, said groove absent regions located between each pair of said plurality of grooves, wherein each groove absent region comprises at least three miniature grooves.

In an additional non-limiting embodiment of the present technology said offset width below and said offset width above of each of said plurality of grooves are each greater than or equal to 0.402 mm.

In an additional non-limiting embodiment of the present technology said grooves and said miniature grooves do not intersect one another.

In an additional non-limiting embodiment of the present technology each groove absent region comprises at least four miniature grooves and less than eight miniature grooves.

In an additional non-limiting embodiment of the present technology each groove absent region comprises five miniature grooves.

In an additional non-limiting embodiment of the present technology said plurality of miniature grooves limited to said central region of said striking face.

An additional non-limiting embodiment of the present technology a plurality of arcuate grooves limited to said toe region; wherein said grooves, said miniature grooves, and said arcuate grooves do not intersect one another.

BRIEF DESCRIPTION OF THE DRAWINGS

The accompanying drawings form a part of the specification and are to be read in conjunction therewith. The illustrated embodiments, however, are merely examples and are not intended to be limiting. Like reference numbers and designations in the various drawings indicate like elements.

DETAILED DESCRIPTION

Figure 1:
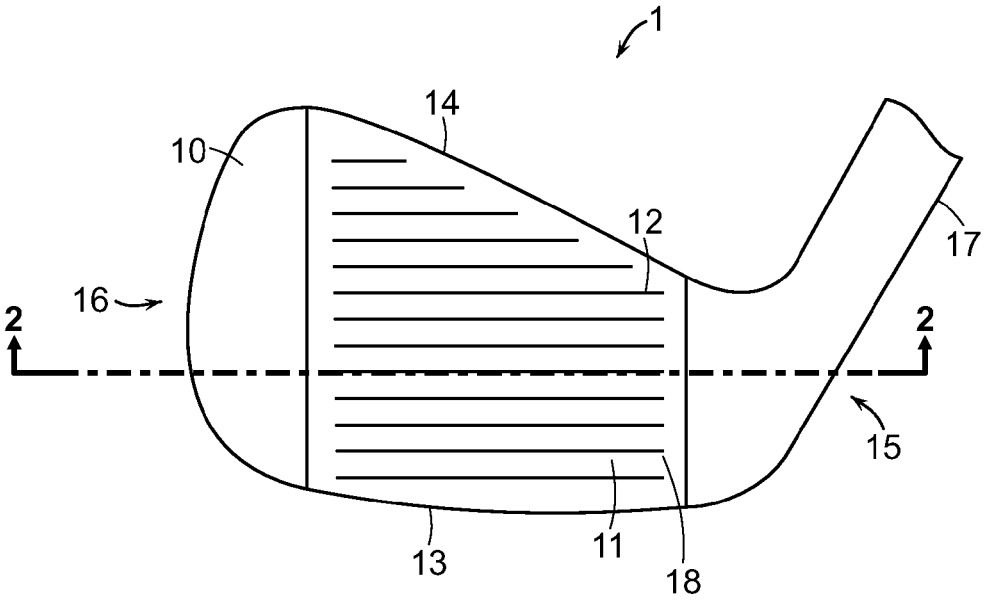
FIG. 1 illustrates an iron type golf club head including a plurality of grooves.

In the following detailed description, reference is made to the accompanying drawings, which form a part of the present disclosure. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, and designed in a wide variety of different configurations, all of which are explicitly contemplated and form part of this disclosure. For example, a system or device may be implemented or a method may be practiced using any number of the aspects set forth herein. In addition, such a system or device may be implemented or such a method may be practiced using other structure, functionality, or structure and functionality in addition to or other than one or more of the aspects set forth herein. Alterations and further modifications of inventive features illustrated herein, and additional applications of the principles of the inventions as illustrated herein, which would occur to one skilled in the relevant art and having possession of this disclosure, are to be considered within the scope of the invention.

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

In describing the present technology, the following terminology may have been used: The singular forms "a," "an," and "the" include plural referents unless the context clearly dictates otherwise. Thus, for example, reference to an item includes reference to one or more items. The term "plurality" refers to two or more of an item. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. A plurality of items may be presented in a common list for convenience. However, these lists should be construed as though each member of the list is individually identified as a separate and unique member. Thus, no individual member of such list should be construed as a de facto equivalent of any other member of the same lists solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to a selection of one of two or more alternatives, and is not intended to limit the selection of only those listed alternative or to only one of the listed alternatives at a time, unless the context clearly indicated otherwise.

Features of the present disclosure will become more fully apparent from the following description and appended claims, taken in conjunction with the accompanying drawings. After considering this discussion, and particularly after reading the section entitled "Detailed Description" one will understand how the illustrated features serve to explain certain principles of the present disclosure.

The present invention is directed to a golf club head with an improved striking surface. FIG. 1 illustrates an iron type golf club head 1. The golf club head 1 includes a body 10 including a striking face 11, a sole 13, a top line 14, a heel 14, a toe 16, and a hosel 17. The front surface 18 of the striking face 11, which includes grooves 12 formed therein, and the sole 13 may be unitary with the body 10, or they may be separate bodies, such as inserts, coupled thereto. While the club head 1 is illustrated as an iron type golf club head, the present invention may also pertain to a utility type golf club head or a wood type golf club head.

Figure 2:
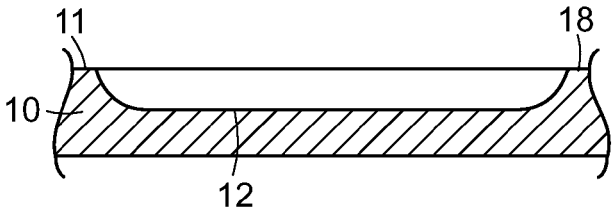
FIG. 2 illustrates a cross section of the club head of FIG. 1 along a groove.
Figure 3:
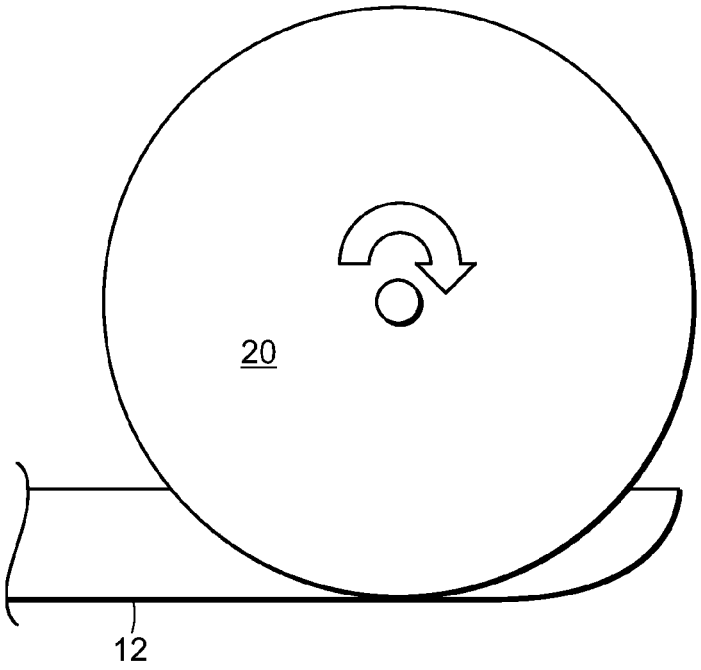
FIG. 3 illustrates the cross section of FIG. 2 including a groove cutter.

FIGS. 2 and 3 illustrate a cross section of the club head 1 along a groove 12. Grooves 12 are machined into the front surface 18 of the striking face 11. Grooves 12 extend from a toe end of the club head 1 to a heel end of the club head 1. Grooves 12 are radiused at the toe and heel portions of the club head 1. The club head 1 is retained in a mold, which preferably is formed of a material soft enough to not damage the club head 1 yet resilient enough to firmly retain the golf club head 1, and a groove cutter 20, preferably a round cutter or a saw cutter, is used to form the grooves 12. As shown, the toe and heel portions are radiused about an axis of rotation that is perpendicular to a longitudinal axis of the groove 12. Furthermore, that axis of rotation is approximately parallel to face 11 of club head 1. Having radiused grooves 12 facilitates removal of dirt, grass, sand, and other materials that typically become embedded within the grooves of a golf club during normal use by eliminating corners that can trap these materials. FIG. 3 shows a preferred groove cutting setup illustrating groove cutter 20 with groove 12. Details about grooves and groove manufacture can be found in more detail in U.S. Pat. No. 7,758,449 to Gilbert, et al., hereby incorporated by reference in its entirety. Any definitions, terminology, or characterizations of the invention included herein shall take precedence over any conflicting information provided in any material incorporated by reference.

Figure 4:
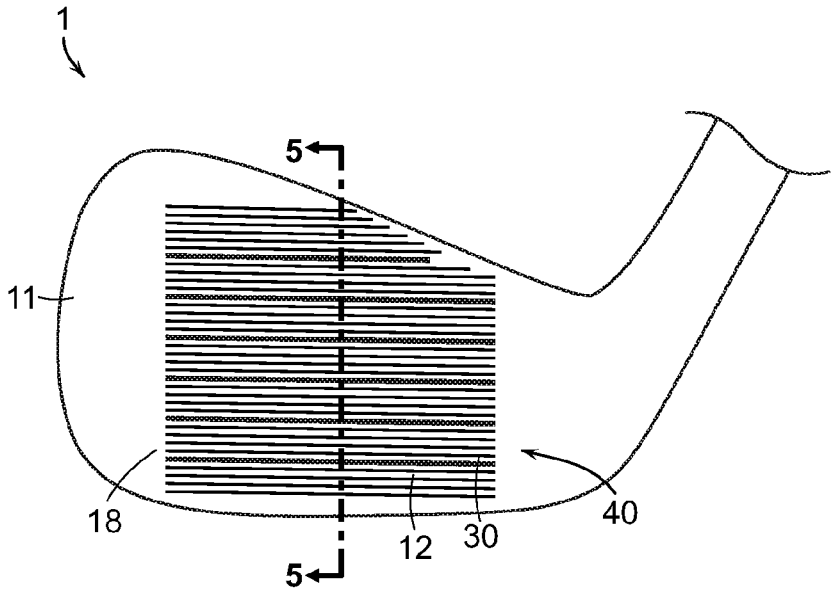
FIG. 4 illustrates an iron type golf club head including a plurality of miniature grooves.

FIG. 4 illustrates an iron type golf club head 1 including a roughened striking surface texture. The face 11 of the club head 1 of the present invention is also enhanced to provide additional ball control and enhanced performance. The strike surface 11 is provided with a roughened texture. A common measure of roughness in surface finish is average roughness, Ra. Ra, also known as Arithmetic Average (AA) and Center Line Average (CLA), is a measure of the distance from the peaks and valleys to the center line or mean. It is calculated as the integral of the absolute value of the roughness profile height over the evaluation length:

$$Ra = \frac{1}{L}\int_0^L |r(x)|\,dx$$

Providing a textured strike face allows the golfer to apply more friction to the ball during use, allowing the golfer to put more spin on the ball and have greater control of the ball. Conventionally, golfers have to take a full swing to induce enough golf ball spin to control the ball movement on a golf green. With the golf club head of the present invention, a golfer can induce golf ball spin in "partial" shots, or shots when the golfer is not taking a full swing. The textured strike surface of the present invention also distributes the shear force resulting from the golf swing over a greater area of the golf ball. This reduces cover damage and extends golf ball life.

As illustrated in FIG. 4, the surface texture can include a plurality of miniature grooves 30. The miniature grooves 30 are smaller than the grooves 12 described above. In some embodiments, as illustrated in FIG. 4, the miniature grooves 30 are oriented parallel to the grooves 12. The miniature grooves 30 can extend from the heel side of the golf club head to the toe side of the golf club head. The miniature grooves 30 can be substantially straight as illustrated in FIG. 4. A plurality of miniature grooves 30 can be formed between each pair of grooves 12.

Figure 5:
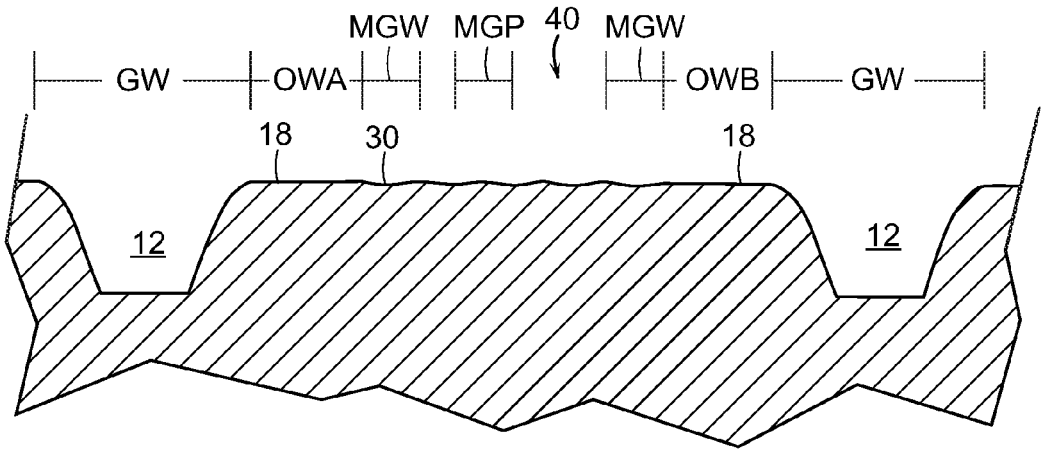
FIG. 5 illustrates a cross section of the golf club head of FIG. 4.
Figure 6:
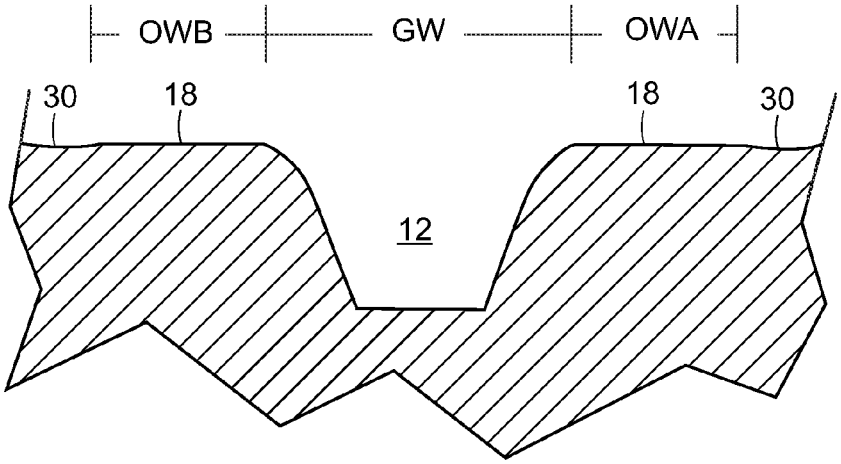
FIG. 6 is a detail view of FIG. 5.
Figure 7:
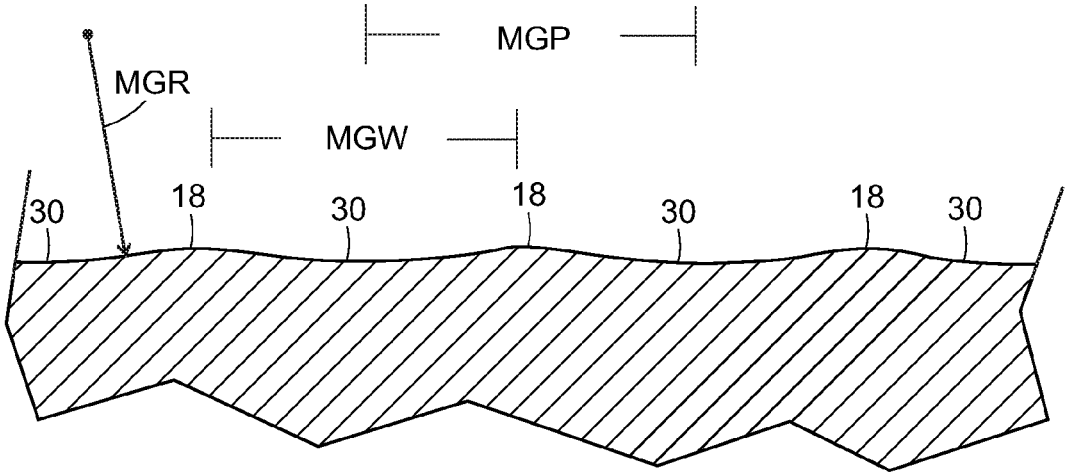
FIG. 7 is a detail view of FIG. 5.

FIG. 5 illustrates a cross section of the golf club head 1 of FIG. 4. FIGS. 6 and 7 zoom in on portions of that cross section. Preferably, the front surface 18 of the striking face 11 is machined flat prior to forming the grooves 12 and miniature grooves 30. Next, the grooves 12 are formed into the striking face 11 as described above. Finally, the miniature grooves 30 are formed into the striking face 11. The grooves 12 and miniature grooves 30 are created by removing material from the striking face 11, and creating voids in the front surface 18 of the striking face 11. Alternatively, the miniature grooves 30 can be formed prior to the grooves 12. In yet another embodiment, the grooves 12 and miniature grooves 30 can be formed simultaneously.

It is preferable that none of the miniature grooves 30 intersect the grooves 12. In order to create as much backspin as possible when the golf club head 1 strikes the golf ball, the grooves 12 must be created as aggressively as allowed by the rules of golf. An inventive way of ensuring that is possible, is by spacing the miniature grooves 30 from the grooves 12. This ensures the area where the grooves 12 are formed, is not encumbered in any way by any additional surface texturing, and that the groove 12 can be formed as designed, without any risk of any other geometries affecting an accurate measurement of the groove 12 characteristics. An additional benefit of spacing the miniature grooves 30 from the groove 12, is that the groove 12 appears larger to a consumer. The miniature grooves 30 can contrast against the groove 12 and the spacing between the groove 12 and the miniature grooves 30, giving the consumer the impression the groove 12 is larger and more effective at gripping the golf ball during impact. The area between each pair of grooves 12 on the front surface 18 of the striking face can each be referred to as groove absent portions 40. In order to maximize backspin of the golf ball at impact, miniature grooves 30 are added to the groove absent portions 40, increasing the amount of friction between the front surface 18 of the striking face 11 and the golf ball during impact. In some embodiments, and as illustrated in FIGS. 5-7, the cross section of the miniature grooves 30 are of substantially constant radius. In some embodiments, each miniature groove 30 may butt up against one another. More preferably, and as illustrated in FIG. 7, portions of the front surface 18 of the striking face 11 will remain between each successive miniature groove 30. In other words, the miniature groove pitch MGP is greater than the miniature groove width MGW.

For purposes of this application, groove width GW is defined by the distance between the points at which each side of the groove 12 intersects the front surface 18 the striking face 11. The miniature groove width MGW is defined by the distance between the points at which each side of the miniature groove 30 intersects the front surface 18 of the striking face 11. The offset width below OWB is the distance between the lower intersection of the groove 12 and the front surface of the striking face and the closest intersection of a miniature groove 30 and the front surface of the striking face. The offset width above OWA is the distance between the upper intersection of the groove 12 and the front surface 18 of the striking face 11 and the closest intersection of a miniature groove 30 and the front surface 18 of the striking face 11. The miniature groove pitch MGP is the distance between corresponding points on each miniature groove 30. The miniature groove radius MGR is the radius of each miniature groove 30.

In some embodiments, the grooves 12 and miniature grooves 30 can have any combination of the following measurements. The groove width GW can be greater than or equal to 0.808 millimeters (mm) and less than or equal to 0.908 mm. The offset width above OWA can be greater than or equal to 0.402 mm and less than or equal to 0.502 mm. The offset width below OWB can be greater than or equal to 0.402 mm and less than or equal to 0.502 mm. The miniature groove width MGW can be greater than or equal to 0.180 mm and less than or equal to 0.280 mm. The miniature groove pitch MGP can be greater than or equal to 0.200 mm and less than or equal to 0.300 mm. The miniature groove can have a substantially constant radius. The miniature groove radius can be greater than or equal to 0.457 mm and less than or equal to 0.657 mm. The groove width GW can be greater than or equal to 0.758 mm and less than or equal to 0.958 mm. The offset width above OWA can be greater than or equal to 0.352 mm and less than or equal to 0.552 mm. The offset width below OWB can be greater than or equal to 0.352 mm and less than or equal to 0.552 mm. The miniature groove width MGW can be greater than or equal to 0.130 mm and less than or equal to 0.330 mm. The miniature groove pitch MGP can be greater than or equal to 0.150 mm and less than or equal to 0.350 mm. The miniature groove radius can be greater than or equal to 0.357 mm and less than or equal to 0.757 mm. The groove width GW can be greater than or equal to 0.708 mm and less than or equal to 1.008 mm. The offset width above OWA can be greater than or equal to 0.302 mm and less than or equal to 0.602 mm. The offset width below OWB can be greater than or equal to 0.302 mm and less than or equal to 0.602 mm. The miniature groove width MGW can be greater than or equal to 0.080 mm and less than or equal to 0.380 mm. The miniature groove pitch MGP can be greater than or equal to 0.100 mm and less than or equal to 0.400 mm. The miniature groove radius can be greater than or equal to 0.257 mm and less than or equal to 0.857 mm. In some embodiments, the offset width above OWA and the offset width below OWB can be substantially the same. Additionally, unless otherwise noted, each plurality of miniature grooves 30 in each groove absent region 40 shares the same characteristics as other pluralities of miniature grooves 30 in other groove absent regions 40 on the striking face 11.

Testing has confirmed that particular relationships between groove 12 and miniature groove 30 measurements result in optimal performance characteristics of the golf club head 1. In particular, grooves 12 and miniature grooves 30 satisfying the following relationship, tend to have near optimal performance:

$$\frac{(OWA + OWB)}{2} > \left(\sqrt{MGP + GW} - \sqrt{MGP + GW - MGW}\right)^3$$

Wherein:

OWA=offset width above

OWB=offset width below

MGP=miniature groove pitch

GW=groove width

MGW=miniature groove width

All values measured in millimeters

Figure 8:
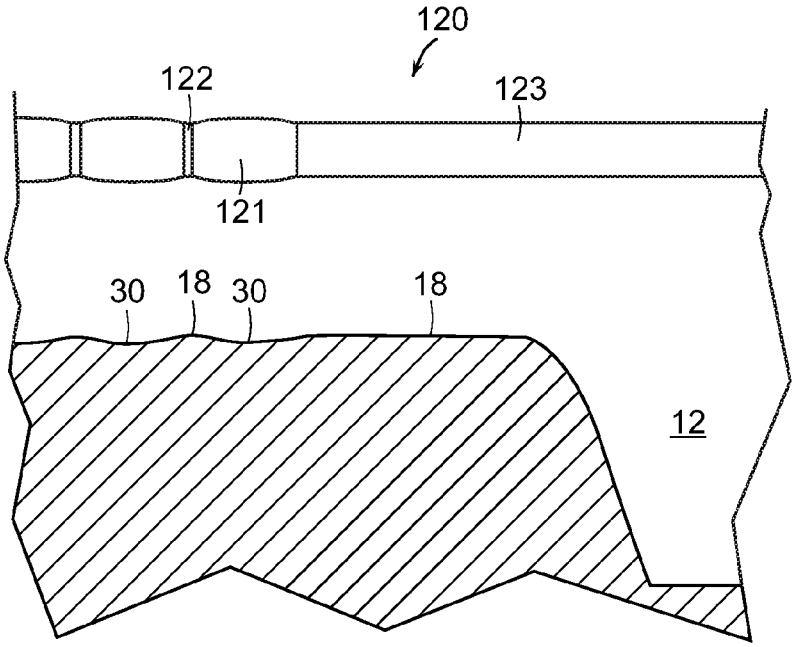
FIG. 8 is a detail view of FIG. 5 including a miniature groove cutter.

FIG. 5 illustrates one method of creating miniature grooves 30. Similar to how the grooves are created, a miniature groove cutter 120 can be used to remove material from the front surface 18 of the striking face 11. In some embodiments, and as illustrated in FIG. 8, the miniature groove cutter 120 can cut a plurality of miniature grooves 30 simultaneously. The miniature groove cutter 120 can include several cutting portions 121 configured to strategically remove material from the front surface 18 of the striking face 11 at the designated areas where the miniature grooves 30 are to go. The miniature groove cutter 120 can include recessed portions 122 in between each cutting portion 122 and extended recess portions 123 in between each set of cutting portions 121. The extended recess portions 123 can extend over each of the grooves 12 and offset width above OWA and offset width below OWB areas. The recessed portions 122 and extended recess portions 123 are configured to not remove any material from the golf club head 1. The miniature groove cutter 120 spins as it translates across the striking face 11, about an axis perpendicular to the striking face 11 and perpendicular to a longitudinal axis of each miniature groove 30, cutting the miniature grooves 30 out of the golf club head. In some embodiments, the miniature groove cutter 120 can cut all of the horizontal miniature grooves 30 at the same time.

Figure 9:
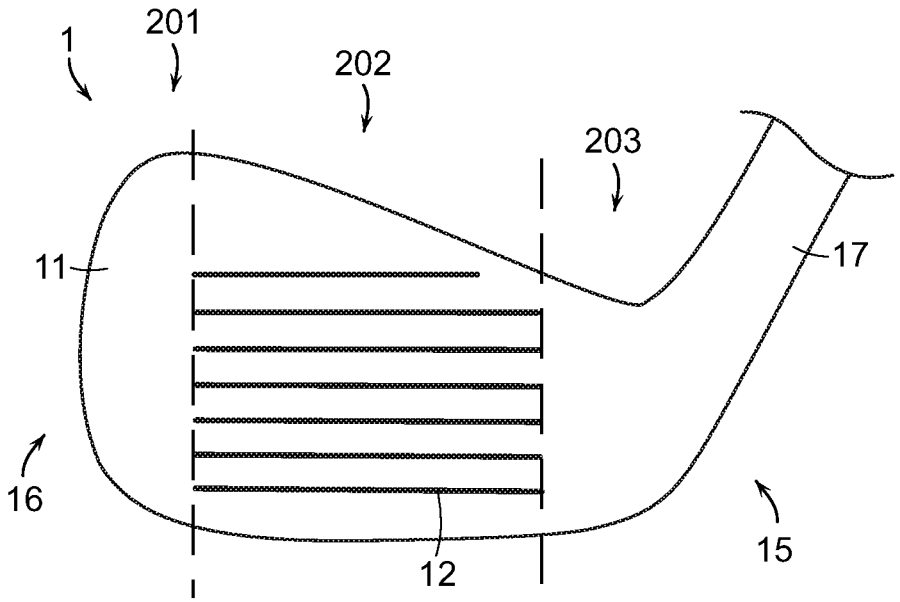
FIG. 9 illustrates an iron type golf club head divided into three regions.
Figure 10:
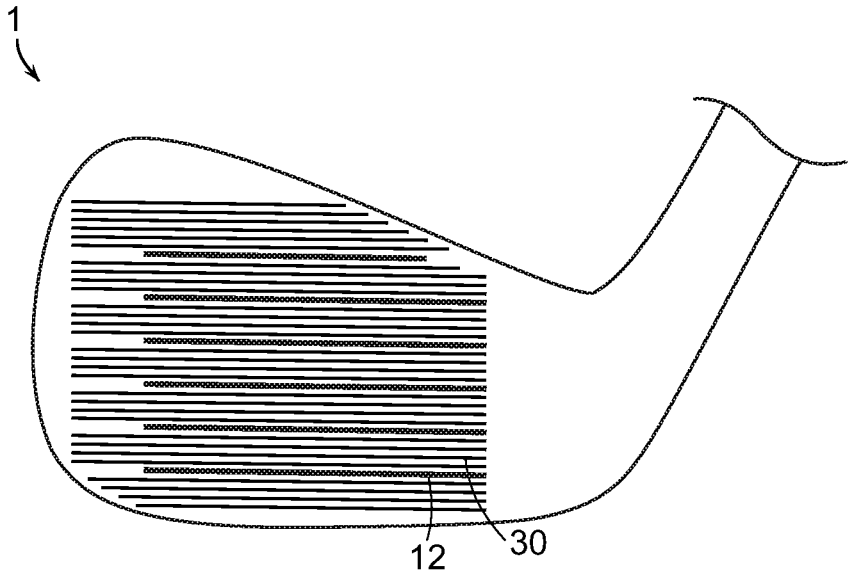
FIG. 10 illustrates an iron type golf club head including a plurality of miniature grooves.
Figure 11:
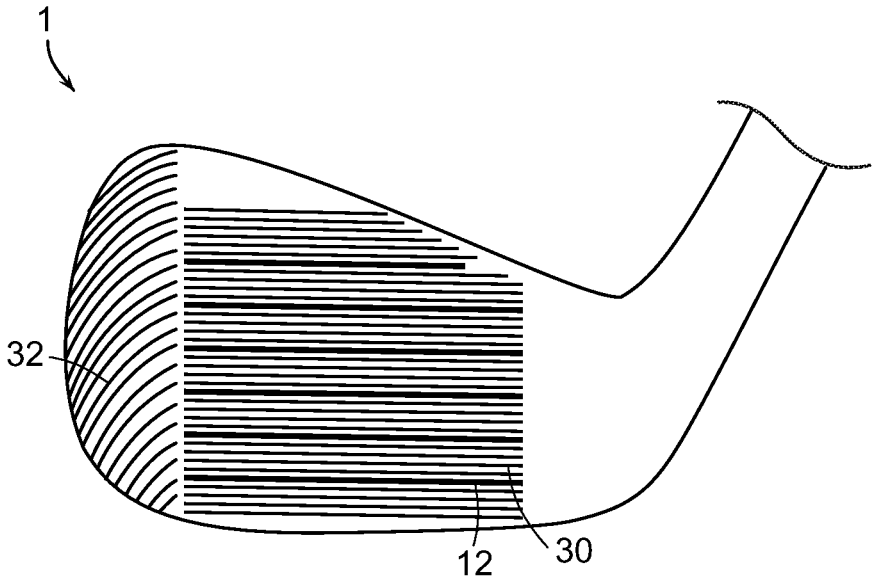
FIG. 11 illustrates an iron type golf club head including a plurality of miniature grooves and a plurality of arcuate grooves.

FIG. 9 illustrates the striking face of an iron type golf club head 1 divided into three regions. The golf club head can have a toe region 201, a center region 202, and a heel region 203. The center region is defined by the extent of the grooves 12. The toe region 201 is located on the toe side of the center region 202 and the heel region 203 is located on the heel side of the center region 202. The heel side 15 located adjacent the hosel 17 and the toe side 16 located opposite the hosel 17. In one embodiment, as illustrated in FIG. 4, the miniature grooves are formed in the center region 202. In another embodiment, as illustrated in FIG. 10, the miniature grooves are formed in the center region 202 as well as the toe region 201. In another embodiment, not illustrated, the miniature grooves 30 can also extend into the heel region 203. In another embodiment, as illustrated in FIG. 11, the miniature grooves 30 are formed in the center region 202 and a second set of miniature grooves 32 are formed in the toe region 201. The miniature grooves 30 in the center region are formed parallel to the grooves 12 as described above. The second set of miniature grooves 32 in the toe region 201 are different from the first set of miniature grooves 30 in the center region 202. The second set of miniature grooves 32 can be curved. In some embodiments, the second set of miniature grooves 32 can be formed with a fly cutter or similar tool.

In describing the present technology herein, certain features that are described in the context of separate implementations also can be implemented in combination in a single implementation. Conversely, various features that are described in the context of a single implementation also can be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure as well as the principle and novel features disclosed herein.

I claim:

1. A golf club head, comprising:

a body, said body comprising:

a striking face on a forward portion of said body, said striking face configured to strike a golf ball;

a sole on a bottom portion of said body;

a top line on a top portion of said body;

a hosel configured to receive a shaft, said hosel located on a heel side of said body, said heel side opposite a toe side of said body;

wherein said striking face comprises a plurality of grooves formed therein, each of said plurality of grooves extending horizontally across said striking face; each of said plurality of grooves having a groove width greater than or equal to 0.500 mm;

wherein said striking face comprises a front surface, and wherein said groove width of each groove is the distance between an uppermost intersection of each groove and said front surface and a lowermost intersection of each groove and said front surface;

wherein said striking face comprises a center region, a toe region, and a heel region, said center region extending from a toe most portion of said grooves to a heel most portion of said grooves, said heel region located on a heel side of said center region and said toe region located on a toe side of said center region;

a plurality of miniature grooves formed in said striking face, said plurality of miniature grooves limited to said center region of said striking face, each of said plurality of miniature grooves extending across said striking face parallel to said grooves, each of said plurality of miniature grooves having a miniature groove width of less than 0.500 mm, wherein said miniature groove width is the distance between an uppermost intersection of each miniature groove and said front surface and a lowermost intersection of each miniature groove and said front surface; and a plurality of arcuate grooves limited to said toe region; wherein said grooves, said miniature grooves, and said arcuate grooves do not intersect one another.

2. The golf club head of claim 1, wherein said striking face comprises a plurality of groove absent regions, said groove absent regions located between each pair of said plurality of grooves, wherein each groove absent region comprises at least three miniature grooves.

3. The golf club head of claim 2, wherein each groove absent region comprises at least four miniature grooves and less than eight miniature grooves.

4. The golf club head of claim 3, wherein each groove absent region comprises five miniature grooves.

5. The golf club head of claim 1, wherein offset width below is the distance between said lowermost intersection of each of said plurality of grooves and said front surface and the closest intersection of said plurality of miniature grooves and said front surface, wherein offset width above is the distance between said uppermost intersection of each of said grooves and said front surface and the closest intersection of said plurality of miniature grooves and said front surface, wherein said offset width below and said offset width above of each of said plurality of grooves are each greater than or equal to 0.352 mm; wherein said golf club head is an iron type golf club head.

6. The golf club head of claim 2, wherein offset width below is the distance between said lowermost intersection of each of said plurality of grooves and said front surface and the closest intersection of said plurality of miniature grooves and said front surface, wherein offset width above is the distance between said uppermost intersection of each of said grooves and said front surface and the closest intersection of said plurality of miniature grooves and said front surface, wherein miniature groove pitch is the distance between corresponding points on each of said plurality of miniature grooves within each of said groove absent regions, and wherein said offset width above, said offset width below, said miniature groove pitch, said groove width, and said miniature groove width, each measured in millimeters, satisfy the following relationship:

$$\frac{(OWA + OWB)}{2} > \left(\sqrt{MGP + GW} - \sqrt{MGP + GW - MGW}\right)^3;$$

wherein said golf club head is an iron type golf club head.

7. A golf club head, comprising:

a body, said body comprising:

a striking face on a forward portion of said body, said striking face configured to strike a golf ball;

a sole on a bottom portion of said body;

a top line on a top portion of said body;

a hosel configured to receive a shaft, said hosel located on a heel side of said body, said heel side opposite a toe side of said body;

wherein said striking face comprises a plurality of grooves formed therein, each of said plurality of grooves extending horizontally across said striking face; each of said plurality of grooves having a groove width greater than or equal to 0.500 mm;

wherein said striking face comprises a front surface, and wherein said groove width of each groove is the distance between an uppermost intersection of each groove and said front surface and a lowermost intersection of each groove and said front surface;

wherein said striking face comprises a center region, a toe region, and a heel region, said center region extending from a toe most portion of said grooves to a heel most portion of said grooves, said heel region located on a heel side of said center region and said toe region located on a toe side of said center region;

a plurality of miniature grooves formed in said striking face, each of said plurality of miniature grooves extending across said striking face parallel to said grooves, each of said plurality of miniature grooves having a miniature groove width of less than 0.500 mm, wherein said miniature groove width is the distance between an uppermost intersection of each miniature groove and said front surface and a lowermost intersection of each miniature groove and said front surface; and a plurality of arcuate grooves limited to said toe region; wherein said grooves, said miniature grooves, and said arcuate grooves do not intersect one another;

wherein offset width below is the distance between said lowermost intersection of each of said plurality of grooves and said front surface and the closest intersection of said plurality of miniature grooves and said front surface, wherein offset width above is the distance between said uppermost intersection of each of said grooves and said front surface and the closest intersection of said plurality of miniature grooves and said front surface, wherein said offset width below and said offset width above of each of said plurality of grooves are each greater than or equal to 0.352 mm;

wherein said striking face comprises a plurality of groove absent regions, said groove absent regions located between each pair of said plurality of grooves, wherein each groove absent region comprises at least three miniature grooves;

wherein said golf club head is an iron type golf club head.

8. The golf club head of claim 7, wherein said offset width below and said offset width above of each of said plurality of grooves are each greater than or equal to 0.402 mm.

9. The golf club head of claim 7, wherein said grooves and said miniature grooves do not intersect one another.

10. The golf club head of claim 9, wherein each groove absent region comprises at least four miniature grooves and less than eight miniature grooves.

11. The golf club head of claim 10, wherein each groove absent region comprises five miniature grooves.

12. The golf club head of claim 7, wherein said plurality of miniature grooves limited to said center region of said striking face.

* * * * *